US012320252B2

(12) United States Patent
Subotic et al.

(10) Patent No.: US 12,320,252 B2
(45) Date of Patent: Jun. 3, 2025

(54) SYSTEMS AND METHODS FOR GENERATING A DOWNLINK SIGNAL

(71) Applicant: Schlumberger Technology Corporation, Sugar Land, TX (US)

(72) Inventors: Milan Subotic, Katy, TX (US); Scott Richard Woolston, Spanish Fork, UT (US); Christopher Paul Reed, West University, TX (US); Pavel Annenkov, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 183 days.

(21) Appl. No.: 17/811,181

(22) Filed: Jul. 7, 2022

(65) Prior Publication Data

US 2023/0009998 A1 Jan. 12, 2023

Related U.S. Application Data

(60) Provisional application No. 63/219,920, filed on Jul. 9, 2021.

(51) Int. Cl.
*E21B 47/20* (2012.01)
*E21B 21/01* (2006.01)

(52) U.S. Cl.
CPC ..... *E21B 47/20* (2020.05); *E21B 21/01* (2013.01)

(58) Field of Classification Search
CPC ..... E21B 47/12; E21B 47/18; E21B 47/20
See application file for complete search history.

(56) References Cited

U.S. PATENT DOCUMENTS

| | | | | |
|---|---|---|---|---|
| 3,550,696 | A * | 12/1970 | Kenneday | E21B 21/08 175/25 |
| 5,802,011 | A | 9/1998 | Winters et al. | |
| 6,182,764 | B1 | 2/2001 | Vaynshteyn | |
| 6,308,137 | B1 | 10/2001 | Underhill et al. | |
| 6,626,253 | B2 | 9/2003 | Hahn et al. | |
| RE38,567 | E | 8/2004 | Gruenhagen | |
| 6,920,085 | B2 | 7/2005 | Finke et al. | |
| 6,975,244 | B2 | 12/2005 | Hahn et al. | |
| 7,167,101 | B2 | 1/2007 | Golla et al. | |
| 7,187,298 | B2 | 3/2007 | Gardner et al. | |
| 7,198,102 | B2 * | 4/2007 | Virally | E21B 47/18 166/249 |
| 7,201,231 | B2 | 4/2007 | Chaplin et al. | |
| 7,345,594 | B2 | 3/2008 | Huang et al. | |
| 7,740,024 | B2 | 6/2010 | Brodeur et al. | |
| 7,983,113 | B2 * | 7/2011 | Krueger | E21B 47/18 340/854.3 |
| 8,272,404 | B2 | 9/2012 | Brunskill et al. | |
| 8,408,331 | B2 | 4/2013 | Patwa et al. | |

(Continued)

FOREIGN PATENT DOCUMENTS

EP 0744527 B1 7/2001

*Primary Examiner* — Robert E Fuller
(74) *Attorney, Agent, or Firm* — Jeffrey D. Frantz

(57) ABSTRACT

A flow regulation system for downlink communication includes a fixed flow valve and a variable flow valve on a discharge line. A pressure sensor is located between the fixed flow valve and the variable flow valve. A sinusoidal communication flow pattern in the drilling fluid is generated by adjusting the position of the variable flow valve based on measured valve pressures from the pressure sensor.

5 Claims, 7 Drawing Sheets

(56) References Cited

U.S. PATENT DOCUMENTS

| | | | | |
|---|---|---|---|---|
| 8,570,833 | B2 * | 10/2013 | Sugiura | E21B 47/22 340/853.3 |
| 8,783,381 | B2 * | 7/2014 | Jeffries | E21B 21/08 73/152.52 |
| 9,013,957 | B2 | 4/2015 | Vecseri et al. | |
| 9,291,049 | B2 | 3/2016 | Switzer et al. | |
| 9,828,853 | B2 | 11/2017 | Chambers | |
| 10,053,919 | B2 | 8/2018 | Kolbe et al. | |
| 10,760,382 | B2 | 9/2020 | Mau et al. | |
| 2003/0016164 | A1 * | 1/2003 | Finke | E21B 47/22 340/854.3 |
| 2011/0214882 | A1 * | 9/2011 | Santos | E21B 21/10 166/85.4 |
| 2015/0034165 | A1 | 2/2015 | Conn et al. | |
| 2015/0034386 | A1 | 2/2015 | Reed et al. | |
| 2016/0273331 | A1 * | 9/2016 | Davis | E21B 21/08 |
| 2018/0266198 | A1 * | 9/2018 | Manum | E21B 21/08 |
| 2022/0065099 | A1 * | 3/2022 | Johnson | E21B 34/025 |

* cited by examiner

SYSTEMS AND METHODS FOR GENERATING A DOWNLINK SIGNAL

CROSS-REFERENCE TO RELATED APPLICATIONS

This application claims the benefit of, and priority to, U.S. Patent Application No. 63/219,920, filed Jul. 9, 2021 and titled "SYSTEMS AND METHODS FOR GENERATING A DOWNLINK SIGNAL", which application is expressly incorporated herein by this reference in its entirety.

BACKGROUND

Hydrocarbon and other fluid reservoirs are often located at depth below the surface of the earth. To access these reservoirs, a wellbore is drilled using a drilling system. Modern drilling systems often utilize specialized equipment, including directional drilling equipment, survey equipment, and so forth. In some situations, a drilling operator may provide information, instructions, or other data to the drilling equipment using a downlink signal.

SUMMARY

In some embodiments, a flow regulation system includes a variable flow valve, a fixed flow valve downstream of the variable flow valve, and an outlet downstream of the variable flow valve. A pressure sensor is located between the fixed flow valve and the variable flow valve.

In some embodiments, a method for generating a downlink signal includes determining a pressure drop across a flow regulation system. The pressure drop is associated with a communication fluid flow. A variable valve pressure is determined based at least partially on the pressure drop and an outlet pressure. A valve pressure is measured using a pressure sensor between the variable flow valve and the fixed flow valve. The position of the variable flow valve is adjusted until the measured valve pressure is equal to the determined valve pressure. In some embodiments, a communication fluid flow pattern is generated by adjusting the variable flow valve. In some embodiments, the communication fluid flow pattern has a sinusoidal shape and/or sinusoidal transitions.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

This disclosure generally relates to devices, systems, and methods for generating downlink fluid flow patterns to communicate with a downhole tool. A downlink communication flow pattern is generated by redirecting drilling fluid to the mud pit before the drilling fluid enters the drill string. A flow regulation system is located in the discharge pipe back to the mud pit. A variable flow valve is located in the discharge pipe, and the downlink flow pattern is generated by adjusting the variable flow valve. The outlet pressure of the discharge pipe is known. A pressure sensor is located downstream of the variable flow valve. The flow rate of the discharge pipe may be determined using the measured pressure and the outlet pressure. A communication pressure pattern may be generated for the communication flow pattern, and the communication flow pattern may be generated by adjusting the variable flow valve so that the measured pressure equals the communication pressure pattern.

In accordance with embodiments of the present disclosure, the fluid flow pattern generated may be sinusoidal, or have a flow pattern that resembles a sine wave, which may include sinusoidal transitions between increases and decreases in flow rate. A sinusoidal flow pattern may allow the drilling operator more variability in fluid flow patterns. This may increase the amount and/or complexity of information transmitted to the downhole tool using fluid flow downlinking. In some embodiments, generating a sinusoidal fluid flow pattern may allow the drilling operator to send more than one band of signals downhole, with different bands having different frequencies. In some embodiments, sinusoidal transitions may aid in the reception of uplink signals transmitted from a downhole tool to the surface.

Figure 1:
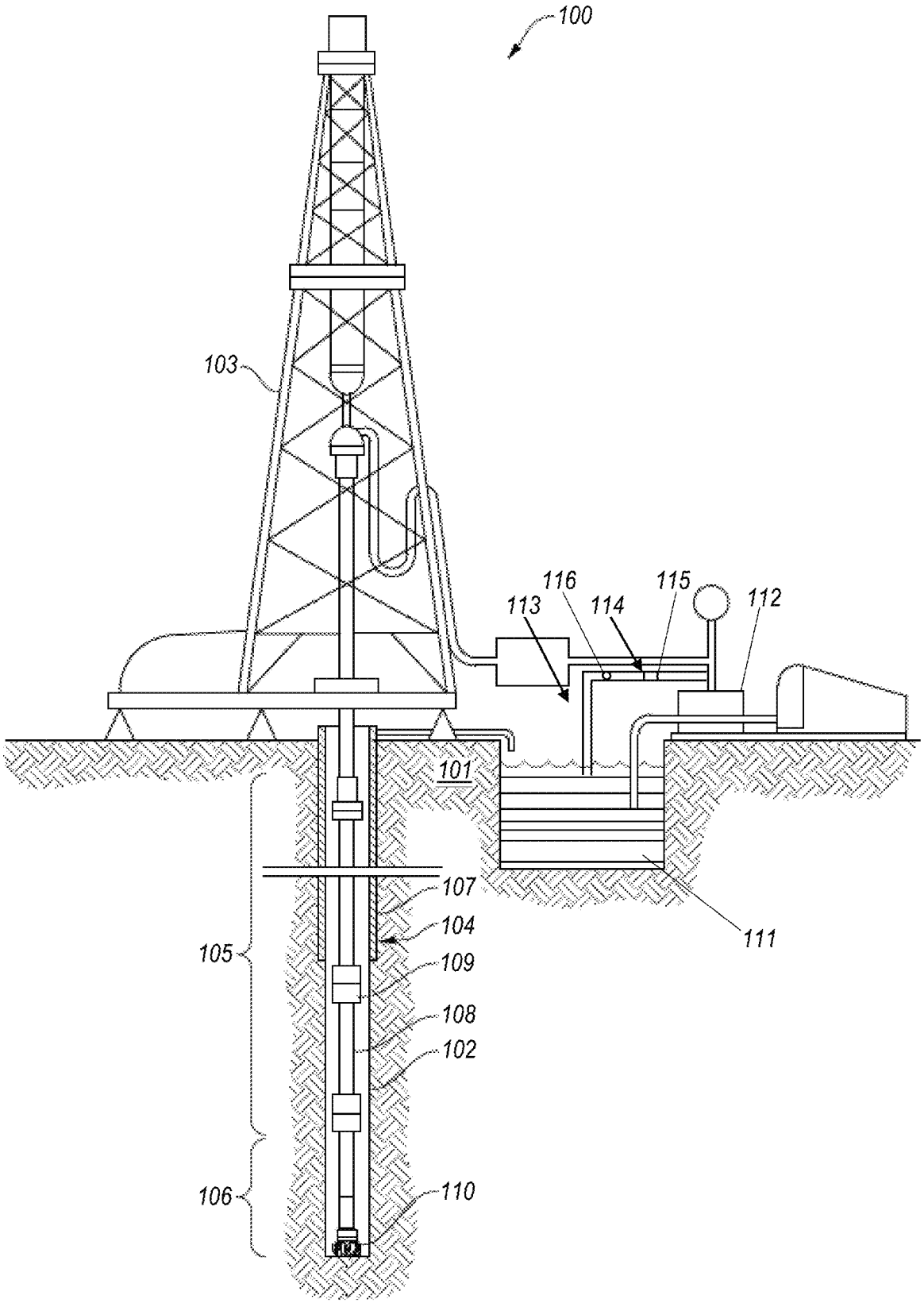
FIG. 1 is representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

Drilling fluid may be stored in a mud pit 111 or a drilling fluid pit. A mud pump 112 may pull the drilling fluid from the mud pit 111 and pump the drilling fluid into the drill string 105. In some situations, a surface operator may communicate with the BHA 106 using variations in the flow rate of the drilling fluid through the drill string 105. The flow rate may be varied in a pattern, with the pattern including encoded information. The BHA 106 may include one or more sensors which may detect the variations in flow rate, such as pressure sensors that may detect a variation in pressure, turbines whose rotational velocity is related to the flow rate of the drilling fluid, any other sensor, and combinations thereof. Communicating from the surface to the BHA 106 may be called downlinking. Downlinking by varying the flow rate of the drilling fluid may be called mud pulse telemetry, mud pulse downlinking, mud pulse communication, and so forth.

Conventionally, varying the fluid flow rate may be accomplished by varying a pumping rate of the mud pump 112. Varying the flow rate of the mud pump 112 may change the flow rate of the drilling fluid. However, the mud pump 112 may only allow for a limited range of frequencies and/or amplitudes of the downlink pattern. This may reduce the amount, quality, type, and so forth of information that may be downlinked. Furthermore, varying the pumping rate of the mud pump may cause increased wear and tear on the mud pump 112. In some situations, the mud pump 112 may have a set number of pumping speeds or rates, resulting in a square wave-shaped downlink signal.

In accordance with embodiments of the present disclosure, variations in the flow rate of the fluid flow may be accomplished by redirecting a portion of the drilling fluid being pumped to the BHA 106 back to the mud pit 111 through a redirected portion 113. The redirected portion of the drilling fluid may be redirected to the mud pit 111 before it enters the drill string 105. This may allow the mud pump 112 to operate at a constant output (e.g., constant pressure and flow rate), which may improve the operational lifetime of the mud pump and/or reduce the amount of operating and maintenance costs of the mud pump 112.

The redirected portion 113 may include a flow regulation system 114. The flow regulation system 114 may include one or more valves which may control the amount of drilling fluid that is redirected to the mud pit 111. For example, the flow regulation system 114 may include a variable flow valve 115. The variable flow valve 115 may control the flow of drilling fluid through the flow regulation system 114. By changing one or more parameters of the variable flow valve 115, the drilling operator may change the amount of drilling fluid that is redirected to the mud pit 111. This may change the amount of fluid flow that reaches the BHA 106. For example, opening the variable flow valve 115 may increase the amount of drilling fluid redirected to the mud pit 111. This may reduce the amount of drilling fluid that reaches the BHA 106. Closing the variable flow valve 115 may decrease the amount of drilling fluid redirected to the mud pit 111, thereby increasing the amount of drilling fluid that reaches the BHA 106. Opening and closing the variable flow valve 115 in a pattern may cause a pattern of fluid flow to reach the BHA. The pattern may include encoded data, which may be decoded at the BHA to allow communication between the BHA and the surface Conventionally, the flow rate through a flow regulation system may be measured using one or more direct measurements, such as a turbine-based flow meter where the fluid flow rotates a turbine, and the rotational rate of the turbine is directly related to the velocity of the drilling fluid. The velocity of the drilling fluid may be converted to a flow rate of the drilling fluid using the diameter of the discharge pipe. However, such flow meters may be difficult to operate and/or subject to breaking down from abrasive elements within the drilling fluid and/or other factors.

In accordance with embodiments of the present disclosure, the flow regulation system 114 may infer the flow rate through the redirected portion 113 using the pressure drop of the drilling fluid across the redirected portion 113, according to Eq. 1:

$$Q = C_v\sqrt{\frac{\Delta P}{s}} \qquad \text{Eq. 1}$$

where Q is the flow rate, $C_v$ is a valve coefficient, ΔP is the pressure drop across the redirected portion, and S is the specific gravity of the drilling fluid. As may be seen in Eq. 1, the flow rate of the drilling fluid may be inferred using known constants (e.g., $C_v$ and S). As discussed in further detail herein, ΔP may be determined using a measured pressure measured at a pressure sensor 116 located downstream of the variable flow valve 115 and a known outlet pressure for the flow regulation system. In this manner, by measuring the pressure downstream of the variable flow valve, the flow rate Q may be determined. Using the flow rate Q of the discharge, the flow rate of drilling fluid to the BHA 106 may be determined. Thus, by varying the flow rate Q of the discharge, the flow rate of the fluid traveling to the BHA 106 may be modified. In this manner, a downlink signal in the drilling fluid to the BHA 106 may be generated by adjusting the variable flow valve 115.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system ("RSS"). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
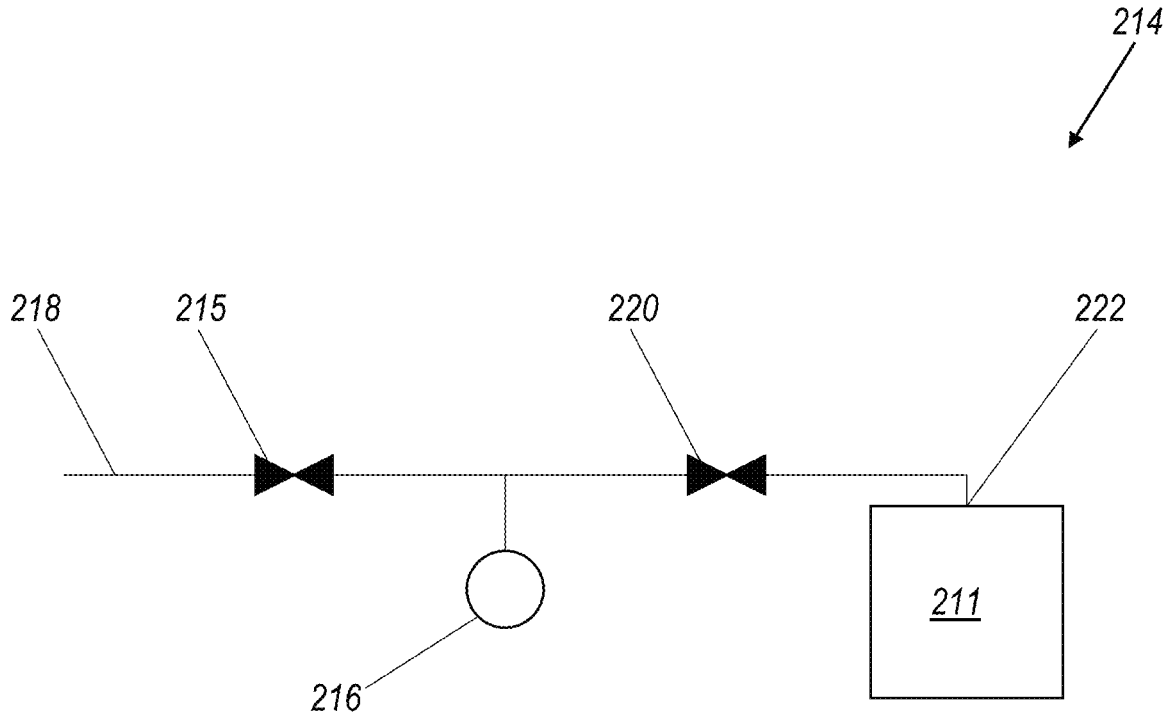
FIG. 2 is a schematic representation of a flow regulation system, according to at least one embodiment of the present disclosure.

FIG. 2 is a schematic representation of a flow regulation system 214, according to at least one embodiment of the present disclosure. The flow regulation system 214 includes a discharge line 218 that redirects a discharge portion of a main fluid flow back to a mud pit 211 (e.g., a drilling fluid pit). The discharge line 218 shown includes a variable flow valve 215, a fixed flow valve 220 located downstream (e.g., closer to the mud pit 211) from the variable flow valve 215, and a pressure sensor 216 between the variable flow valve 215 and the fixed flow valve 220. The discharge line 218 discharges drilling fluid into the mud pit 211 at an outlet 222.

As discussed above, the fluid flow through the discharge line 218 may be inferred or determined using Eq. 1. In Eq. 1, ΔP may be determined using Eq. 2:

$$\Delta P = P_v - P_d \qquad \text{Eq. 2}$$

where $P_v$ is the pressure at the downhole side of the variable flow valve 215 and $P_d$ is the pressure loss across discharge line 218 between the variable flow valve 215 and the outlet 222. In some embodiments $P_d$ may be determined using Eq. 3:

$$P_d = P_f + P_o \qquad \text{Eq. 3}$$

where $P_f$ is the pressure drop across the fixed flow valve and $P_o$ is the outlet pressure. In some embodiments, the outlet 222 may discharge to the atmosphere (e.g., the outlet 222 may discharge above the mud pit 211, or may not experience any significant source of head pressure being submerged in the mud pit 211). Thus, $P_o$ may be zero, or may be approximately zero. Using Eq. 3, this may result in $P_d$ being equal or approximately equal to $P_f$. This may allow Eq. 2 to be modified to Eq. 4 and Eq. 5:

$$\Delta P = P_v - P_f \qquad \text{Eq. 4}$$

$$P_v = \Delta P + P_f \qquad \text{Eq. 5}$$

As discussed herein, to generate a downlink signal using variations in the fluid flow at the BHA, a discharge flow Q may be redirected from the main flow path through the discharge line 218. Increasing the discharge flow Q may decrease the main fluid flow rate, and decreasing the discharge flow Q may increase the main fluid flow. Thus, the discharge flow Q may have an inverse relationship with the main fluid flow to the BHA.

A downlink signal may be generated using (e.g., associated with) a communication flow pattern of high and low flow at the BHA to downlink a communication to the BHA. The downlink signal may include encoded data, such as instructions for the BHA, direction changes, requests for survey measurements, any other encoded data, and combinations thereof. The communication flow pattern may be generated using a discharge flow pattern through the discharge line 218. In some embodiments, the discharge flow pattern may be the inverse (or inverted relative to) the communication flow pattern. To generate the communication flow pattern, the flow regulation system 214 may control the discharge flow Q so that the discharge flow Q follows the discharge flow pattern.

The discharge flow Q may be varied by adjusting a position or setting of the variable flow valve 215. The variable flow valve 215 may be any variable flow valve, such as a choke valve, a throttling valve, a gate valve, a globe valve, a pinch valve, a diaphragm valve, a needle valve, any other variable flow valve, and combinations thereof.

In some embodiments, the variable flow valve 215 may be movable between a fully open and a fully closed position. In the fully open position, the discharge flow rate Q may be maximized. In the fully closed position, the discharge flow rate Q may be minimized. In some embodiments, in the fully closed position, the variable flow valve 215 may be closed, and the discharge flow rate Q may be reduced to zero. In some embodiments the variable flow valve 215 may be a bi-stable valve that is stable in the fully open position and the fully closed position. In some embodiments, the variable flow valve 215 may be continuously adjustable between the fully open and the fully closed positions. For example, the variable flow valve 215 may be stable (e.g., remain open while the discharge fluid is passing through the variable flow valve 215) at any position between the fully open and the fully closed position. In this manner, a fully adjustable variable flow valve 215 may allow for a large degree of control over the discharge flow pattern. In some embodiments, the variable flow valve 215 may allow for a gradual change between the maximum discharge flow rate Q and the minimum flow discharge flow rate Q. This may help to reduce wear and tear on drilling equipment due to sudden changes in pressure and/or discharge flow rate Q.

In some embodiments, a gradual change between maximum and minimum discharge flow rates Q may help to generate a sinusoidal downlink pattern, or to generate sinusoidal transitions between the maximum and minimum discharge flow rates, or sinusoidal transitions between any two discharge flow rates. Sinusoidal transitions between flow rates may help to maintain clean downlink communication signals. Conventionally, simply shutting the pumps on and off to generate a square wave may generate a large amount of bleed over and/or contamination of the surrounding frequency bands of fluid pulse signals. This may increase the noise in a received signal, thereby reducing the resolution of a received signal. Smoothly generating a sinusoidal transition between flow rates may reduce the bleed over and/or contamination of a signal into different frequency bands. This may improve the reception of signals, including the reception of signals on different frequency.

In some embodiments, a BHA may generate an uplink signal using mud pulse telemetry. Such uplink signals may have a lower amplitude, and the signal may be difficult to retrieve or even lost if there is too much noise due to bleed over and/or contamination from the downlink signal. A downlink signal with sinusoidal transitions between flow rates may help to reduce the bleed over and contamination of the uplink frequency bands, thereby improving the signal-to-noise ratio of the transmission. This may allow the drilling operator to more easily perform uplinking and downlinking simultaneously and/or to transmit more information while uplinking and downlinking simultaneously.

In some embodiments, the variable flow valve 215 may move between positions other than fully open (e.g., 100% open) and fully closed (e.g., 0% open). For example, the variable flow valve 215 may start at fully closed, move to 75% open, move to 25% open, move to 90% open, move to 15% open, and so forth. By varying the sequence and amount (e.g., percentage open) of opening and closing the variable flow valve 215, the discharge flow rate Q may be varied in the discharge flow pattern.

In accordance with embodiments of the present disclosure, a pressure sensor 216 may be located between the variable flow valve 215 and the fixed flow valve 220. The pressure sensor 216 may determine the valve pressure $P_v$ above the fixed flow valve 220. In some embodiments, the fixed flow valve may have a fixed pressure drop $P_f$. For example, the fixed flow valve 220 may be a choke valve with the choke having a fixed orifice opening that generates a known fixed pressure drop $P_f$ for a given flow rate Q and a given density S. Using the pressure sensor 216 to measure the valve pressure $P_v$ and the known fixed pressure drop $P_f$, the pressure drop ΔP across the flow regulation system 214 may be determined using Eq. 4. With the determined pressure drop ΔP, the discharge flow rate Q may be determined using Eq. 1.

In some embodiments, the fixed flow valve 220 may have a desired valve coefficient $C_v$. As may be seen in Eq. 1, if the flow rate, valve coefficient, and specific gravity S are known, then the pressure drop ΔP across the fixed flow valve may be determined. Thus, for a constant specific gravity S, the pressure drop across a fixed flow valve 220 having a particular valve coefficient $C_v$ may be determined for any given flow rate Q.

In accordance with embodiments of the present disclosure, the fixed flow valve 220 may be fixed choke or restriction in a portion of the discharge line 218. As discussed above, the fixed choke of the fixed flow valve 220 may have a known pressure drop for known fluid properties, such as for a known flow rate Q and a known fluid density or specific gravity S. In this manner, as the flow rate Q changes, the change in the pressure drop across the fixed flow valve 220 may be determined. In some embodiments, the fixed flow valve 220 may be a valve having a variable opening. During operation, the variable opening of the fixed flow valve 220 may be held in a particular position, and the pressure across the fixed flow valve 220 may be determined based on the flow rate Q and the specific gravity of the drilling fluid. In some embodiments, as the flow rate Q varies, the position of the fixed flow valve 220 may be changed to maintain a constant pressure across the fixed flow valve.

As discussed herein, to generate the downlink signal in the fluid flow rate at the BHA, the discharge flow rate Q may be generated in the discharge flow pattern. In some embodiments, a drilling operator may develop a downlink signal that includes encoded data. The drilling operator may determine a communication flow pattern for the downlink signal. Using the communication flow pattern, the drilling operator may develop a discharge flow pattern. The discharge flow pattern may include the discharge flow rate Q over a period of time. The discharge flow pattern may be generated by varying the variable flow valve 215.

Using the discharge flow rate Q from the discharge flow pattern, the pressure at the variable flow valve 215 may be determined. For example, Eq. 1 may be written by substituting ΔP with Eq. 4:

$$Q = C_v\sqrt{\frac{P_v - P_f}{S}} \qquad \text{Eq. 6}$$

Eq. 6 may then be rearranged to solve for $P_v$:

$$P_v = S\left(\frac{Q}{C_v}\right)^2 + P_f \qquad \text{Eq. 7}$$

Because the fixed valve pressure $P_f$ is known, for a given discharge flow rate Q, the variable flow valve pressure $P_v$ may be determined using Eq. 7. In this manner, using the discharge flow pattern, a variable valve pressure pattern may be developed. A drilling operator may then generate the discharge flow pattern by moving adjusting the variable flow valve 215 to match the variable valve pressure pattern.

During operation of the flow regulation system 214, a variable valve pressure may be measured between the variable flow valve 215 and the fixed flow valve 220 using a pressure sensor 216. To generate the discharge flow rate Q, the position of the variable flow valve 215 may be adjusted until the measured variable valve pressure is equal to the determined variable valve pressure, determined from Eq. 7. In this manner, the discharge flow pattern may be generated by continuously monitoring the variable valve pressure at the pressure sensor 216 and continuously adjusting the position of the variable flow valve 215. A discharge flow pattern generated in this manner may experience increased accuracy, sensitivity, variability, and combinations thereof. This may increase the amount and/or complexity of information available to be transmitted.

In some embodiments, a feedback loop may be established between the variable flow valve 215 and the pressure sensor 216. For example, for a given discharge flow rate Q and associated variable valve pressure, a measured valve pressure may be determined using the pressure sensor 216. If the measured valve pressure is different than the variable valve pressure associated with the discharge flow rate Q, then the position of the variable flow valve 215 may be adjusted until the measured valve pressure equals the variable valve pressure. For example, if the measured valve pressure is higher than the variable valve pressure, then the variable flow valve 215 may be closed to reduce the valve pressure. If the measured valve pressure is less than the variable valve pressure, then the variable flow valve 215 may be opened to increase the valve pressure. Establishing a feedback loop may help to improve the accuracy and/or precision of the discharge flow rate.

In some embodiments, a pre-determined communication position of the variable flow valve may be associated with each determined variable valve pressure. For example, the communication position associated with a variable valve pressure may be determined based at least partially on one or more previous positions of the variable flow valve used to achieve the variable valve pressure. To generate the discharge flow pattern, the variable flow valve may be moved to each respective communication position for the pressure pattern. Put another way, adjusting the position of the variable flow valve may include adjusting the position of the variable flow valve to the communication position. In some embodiments, the communication position may be an estimated position. To generate a discharge flow rate Q, the valve position may be moved to the estimated communication position associated with the variable valve pressure. The valve pressure may then be measured using the pressure sensor 216, and the communication position adjusted if the measured valve pressure is different from the determined variable valve pressure. Utilizing estimated or otherwise pre-determined positions for the variable flow valve 215 may help to increase the responsiveness and/or reduce the time it takes to generate the discharge flow rate Q.

In some embodiments, the position of the fixed flow valve 220 may be determined to optimize the working range of the variable flow valve 215. For example, the variable flow valve 215 may have an operating range of positions, resulting in an operating range of fluid flow rates that may be generated. In some embodiments, the position of the fixed flow valve 220 may be changed to increase the operating range of the variable flow valve 215. This may help to maximize the resolution of the variable flow valve 215, which may help to generate cleaner downlink signals and/or improve the quality of the sinusoidal transitions in the downlink signal.

As may be seen in FIG. 2, the flow regulation system 214 may include a single pressure sensor 216. Because the pressure across the fixed flow valve 220 is known, the pressure drop across the entire flow regulation system 214 may be determined using a single pressure sensor 216 (e.g., with no other pressure sensors than the single pressure sensor 216). This may reduce the cost of the flow regulation system 214. In some embodiments, a single pressure sensor 216 may help to reduce the overall length and/or complexity of the flow regulation system 214. For example, each pressure sensor may add lengths of pipe to the flow regulation system 214, which may add to the cost and/or complexity of the flow regulation system 214.

In some embodiments, the redirected flow from the main fluid flow through the discharge line 218 may be controlled using a gate valve located between the variable flow valve 215 and the main fluid flow. The gate valve may be opened when a drilling operator wishes to generate a downlink signal, and closed when the drilling operator is not downlinking. In some embodiments, the variable flow valve 215 may close completely so that no drilling fluid may be redirected to the mud pit 211, reducing or eliminating the need for a gate valve.

Figure 3:
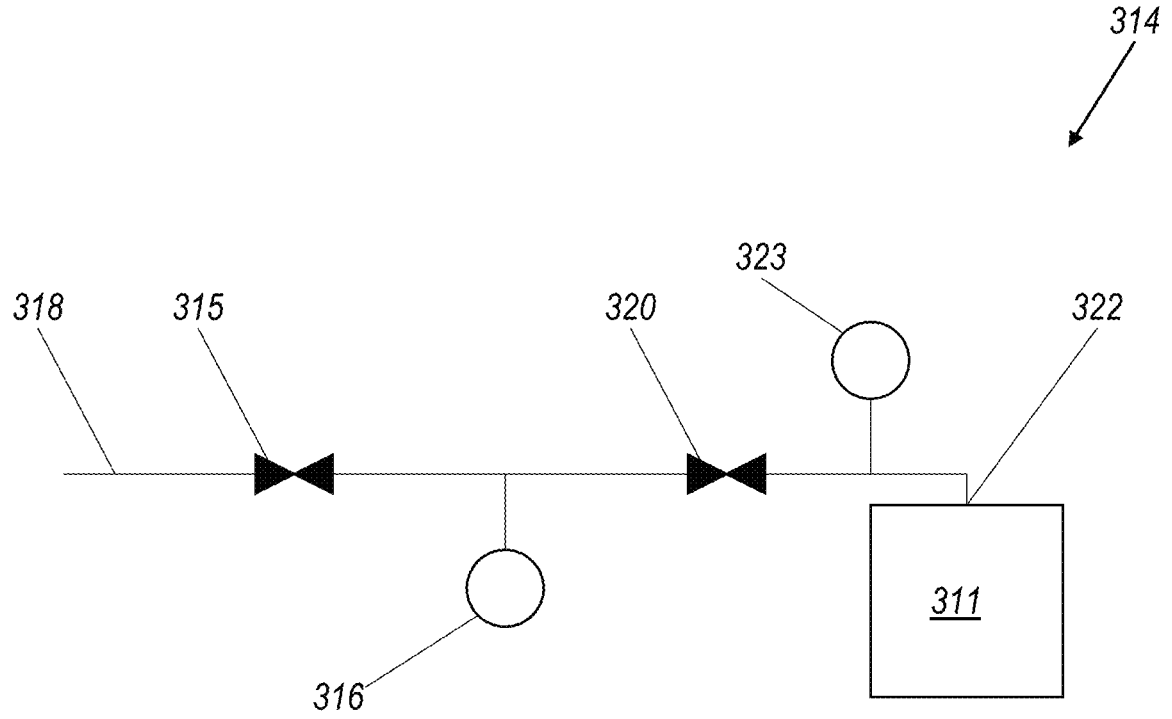
FIG. 3 is a schematic representation of a flow regulation system, according to at least one embodiment of the present disclosure.

FIG. 3 is a representation of a flow regulation system 314 having two pressure sensors, according to at least one embodiment of the present disclosure. The flow regulation system 314 includes a discharge line 318 that redirects at least a portion of a drilling fluid flow to a mud pit 311. A first pressure sensor 316 may measure a variable valve pressure between a variable flow valve 315 and a fixed flow valve 320. A second pressure sensor 323 may measure a fixed valve pressure between the fixed flow valve 320 and an outlet 322 to the mud pit 311. The difference between the first pressure sensor 316 and the second pressure sensor 323 may provide a precise ΔP used in the flow rate calculations. This may help to improve the precision of the discharge flow pattern. For example, directly measuring ΔP may help to generate an actual discharge flow pattern that more closely matches a determined discharge flow pattern.

Figure 4:
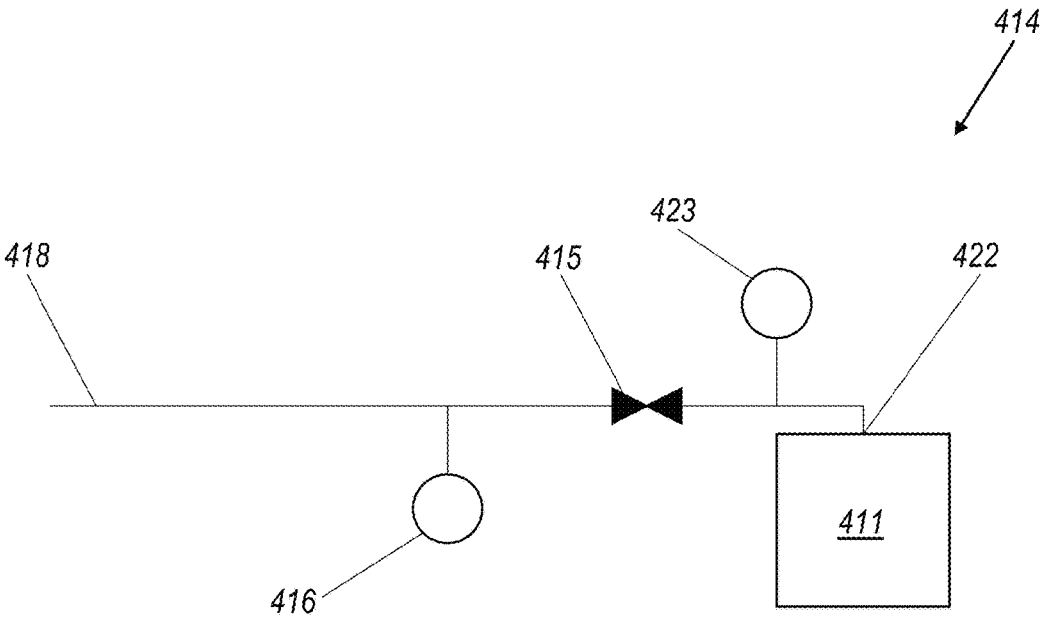
FIG. 4 is a schematic representation of a flow regulation system, according to at least one embodiment of the present disclosure.

FIG. 4 is a representation of a flow regulation system 414 having two pressure sensors and a single variable flow valve 415, according to at least one embodiment of the present disclosure. A discharge line 418 redirects at least a portion of a drilling fluid flow to a mud pit 411. A single variable flow valve 415 may be located on the discharge line 418. A first pressure sensor 416 may be located above the variable flow valve 415 and a second pressure sensor 423 may be located between the variable flow valve 415 and an outlet 422 into the mud pit 411. In the embodiment shown, the flow regulation system 414 includes a single variable flow valve 415, and does not include a fixed flow valve. This may help to simplify the construction of the flow regulation system 414. Furthermore, as discussed herein, utilizing a first pressure sensor 416 upstream of the variable flow valve 415 and a second pressure sensor 423 downstream of the variable flow valve 415 may provide a precise ΔP used in the flow rate calculations. This may help to improve the precision of the discharge flow pattern. For example, directly measuring ΔP may help to generate an actual discharge flow pattern that more closely matches a determined discharge flow pattern.

Figure 5:
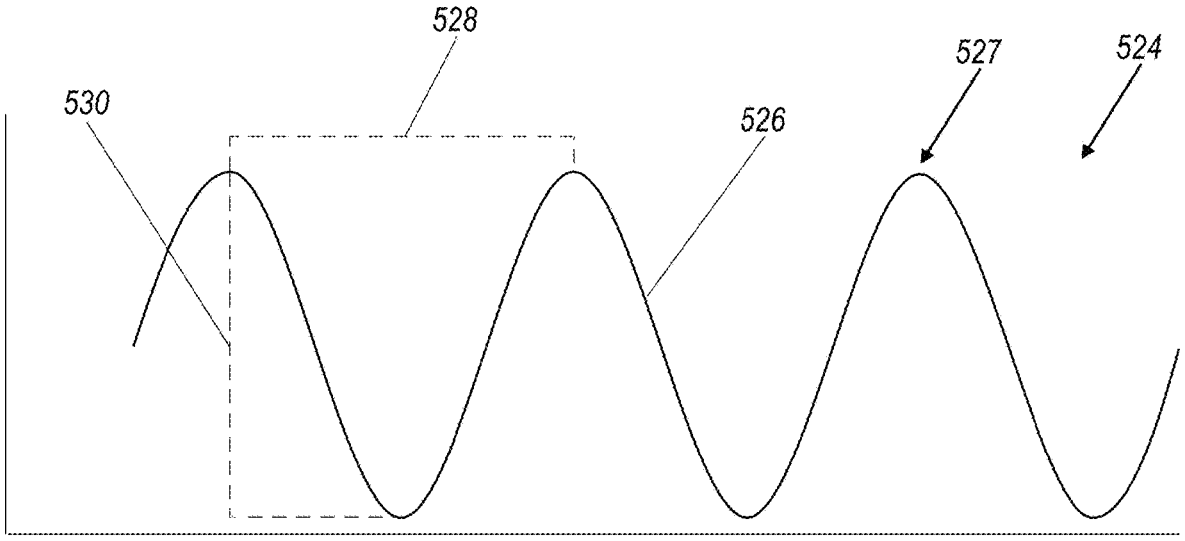
FIG. 5 is a representation of a discharge flow chart, according to at least one embodiment of the present disclosure.

FIG. 5 is a representation of a discharge flow chart 524 having time on the x-axis (e.g., the horizontal axis) and discharge flow rate on the y-axis, according to at least one embodiment of the present disclosure. The discharge flow chart 524 includes a discharge flow pattern 526. The discharge flow pattern 526 is the flow rate of drilling fluid routed through a flow regulation system, such as the flow regulation system 114 of FIG. 1. As discussed herein, the discharge flow pattern 526 may be controlled or otherwise varied by changing or adjusting the position of a variable flow valve (e.g., the variable flow valve 215 of FIG. 2). The discharge flow pattern 526 may be determined using a single sensor located between the variable flow valve and a fixed flow valve.

In some embodiments, the variable flow valve may be adjustable to any position between fully open and fully closed. This may allow for a controlled discharge flow pattern 526. As may be seen, the discharge flow pattern 526 includes sinusoidal transitions 527 (e.g., the discharge flow pattern 526 has a sinusoidal shape). To generate the sinusoidal transitions 527 of the discharge flow pattern 526, the position of the variable flow valve may be gradually changed over a period of time. For example, the position of the variable flow valve may be gradually opened to increase the discharge flow rate, and gradually closed to decrease the discharge flow rate.

In accordance with embodiments of the present disclosure, the sinusoidal transitions 527 have a generally rounded shape. In a sinusoidal transition 527, there may be no constant flow rate. The flow rate may constantly change from the low flow rate to the high flow rate. In some embodiments, the sinusoidal transition 527 may be curved. In some embodiments, portions of the sinusoidal transition 527 may be parabolic. In some embodiments, the sinusoidal transition 527 may have substantially few frequencies. For example, a pure sine wave may have a single frequency in a sinusoidal transition 527, while a pure square wave may have an infinite number of frequencies in a sinusoidal transition 527. In some embodiments, the sinusoidal transition 527 may have 1, 2, 3, 4, 5, 6, 7, 8, 9, 10, 15, 20, or fewer frequencies. In some embodiments, the sinusoidal transition 527 may not be a square wave.

In some embodiments, as discussed herein, adjusting the position of the variable flow valve may cause the discharge flow pattern to be discharged into the mud pit. This may cause the drilling fluid flow to the BHA to vary by the discharge fluid flow. By adjusting the position of the variable flow valve, the discharge flow pattern may have a sinusoidal shape. This may generate a sinusoidal communication flow pattern of the drilling fluid.

In accordance with embodiments of the present disclosure, a sinusoidal discharge flow pattern 526 may resemble a wireless transmission signal. Information may be encoded within the discharge flow pattern by varying one or both of a frequency 528 or an amplitude 530 of the discharge flow pattern 526. Furthermore, similar to wireless transmission signals, a sinusoidal discharge flow pattern may allow for two or more downlink signals to be generated at different frequencies. This may increase the amount and/or complexity of information that may be downlinked to the BHA.

Figure 6:
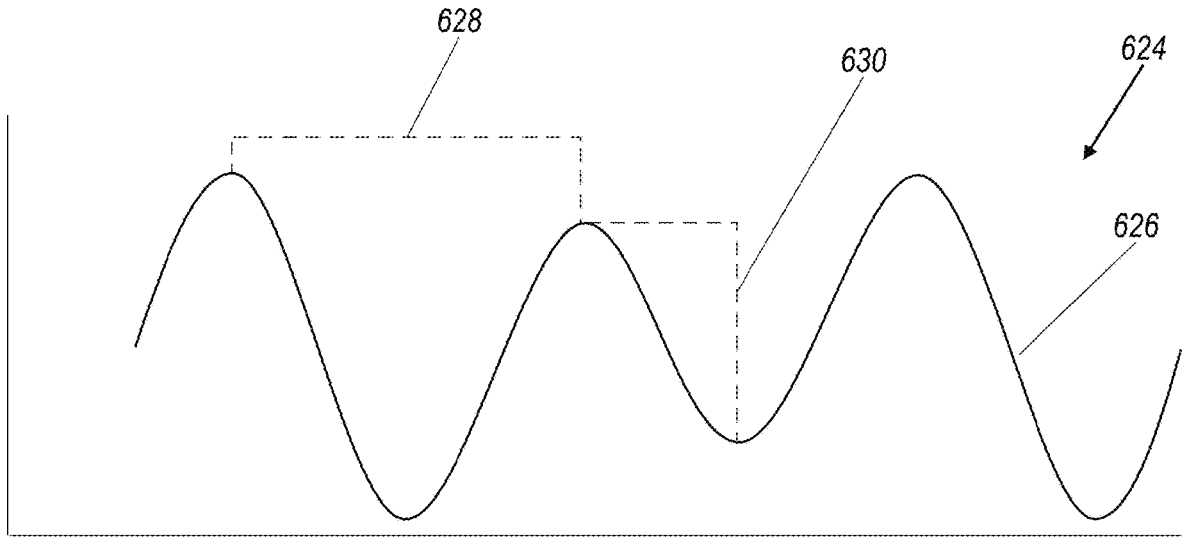
FIG. 6 is a representation of a discharge flow chart, according to at least one embodiment of the present disclosure.
Figure 7:
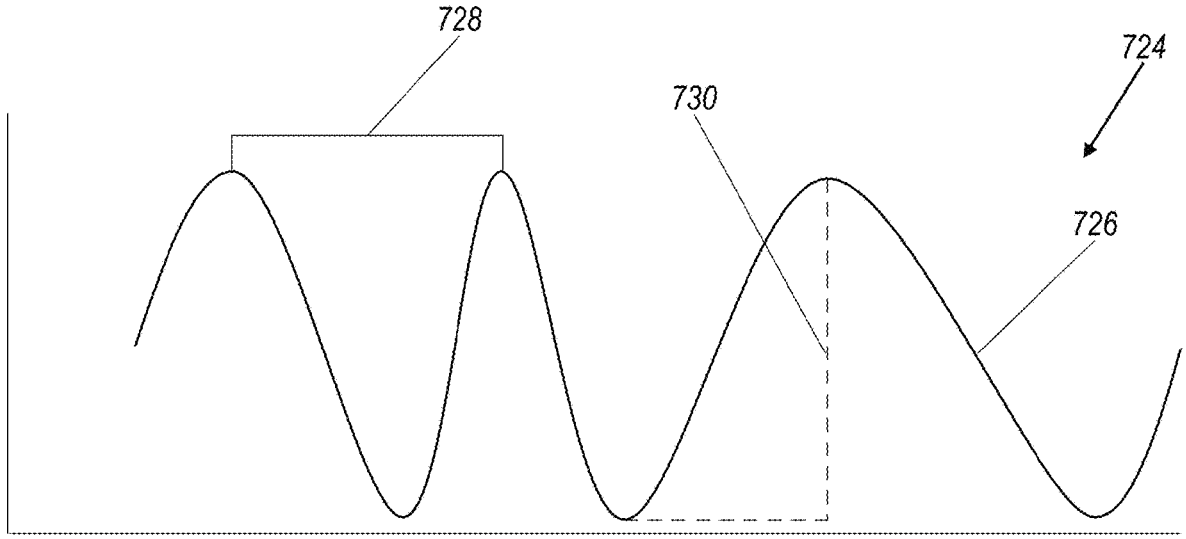
FIG. 7 is a representation of a discharge flow chart, according to at least one embodiment of the present disclosure.

The discharge flow pattern 526 shown in FIG. 5 has a constant, or substantially constant frequency 528 and amplitude 530. In some embodiments, by adjusting the position of the variable flow valve, the frequency 528 and/or amplitude 530 may be adjusted. Adjusting the frequency 528 and/or amplitude 530 of the discharge flow pattern 526 allows a drilling operator to encode data in the downlink signal. As may be seen in the discharge flow chart 624 of FIG. 6, the amplitude 630 of the discharge flow pattern 626 may be varied along the length of the discharge flow pattern 726. As may be seen in the discharge flow chart 724 of FIG. 7, the frequency 728 of the discharge flow pattern 726 may be varied along the length of the discharge flow pattern 726. For ease of illustration, the frequency 628 of FIG. 6 and the amplitude 730 of FIG. 7 have not been varied along the lengths of their respective discharge flow patterns 626, 726. However, it should be understood that, consistent with embodiments of the present disclosure, the frequency, the amplitude, or both the frequency and the amplitude of the discharge flow pattern may be changed along its length. In this manner, the discharge flow pattern may be used to generate a downlink signal in fluid flow of drilling fluid to the BHA.

Figure 8:
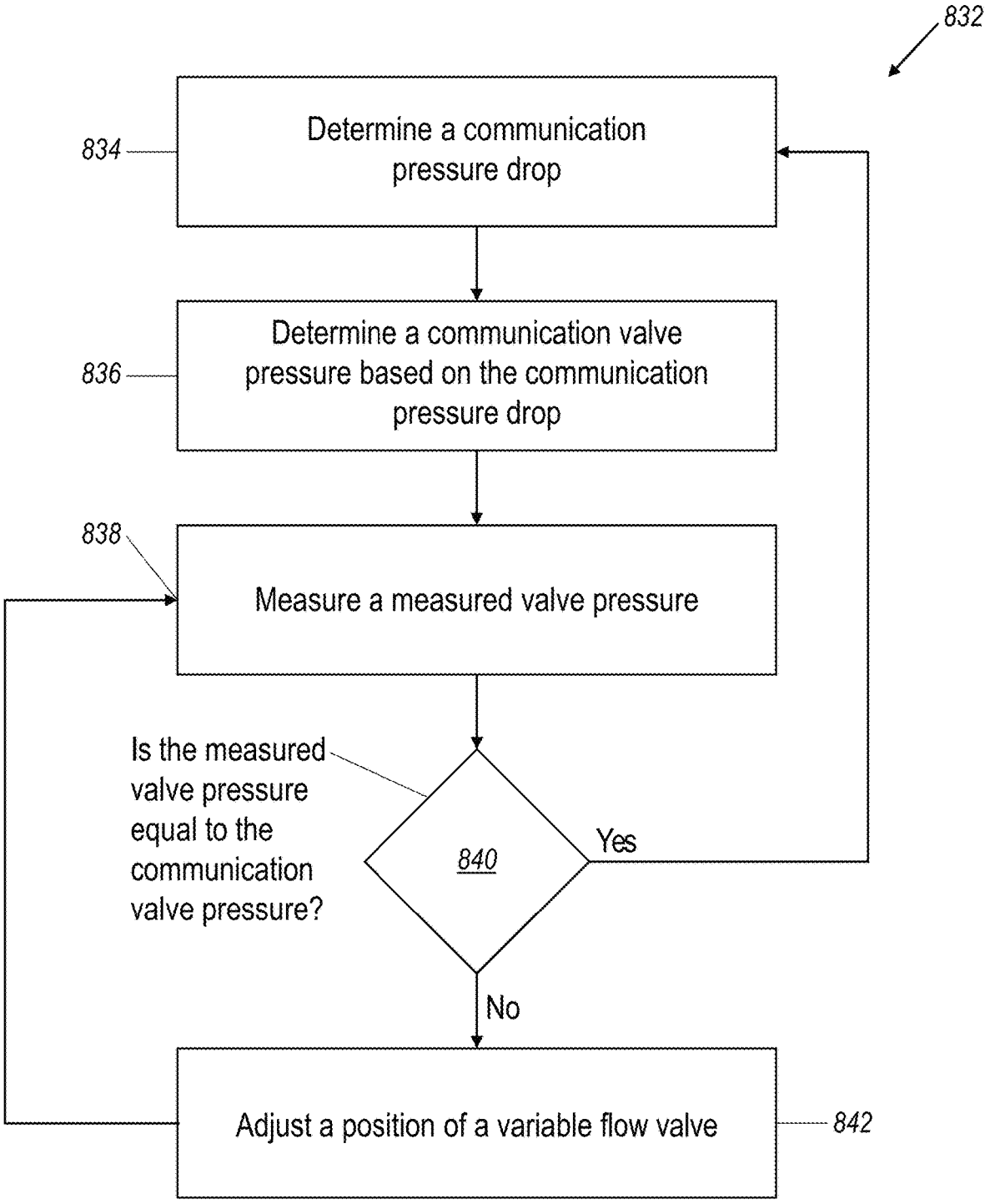
FIG. 8 is a flow chart of a method for generating a downlink signal, according to at least one embodiment of the present disclosure.

FIG. 8 is a flowchart of a method 832 for generating a downlink signal, according to at least one embodiment of the present disclosure. In accordance with embodiments of the present disclosure, the method 832 may be implemented by the flow regulation system 214 of FIG. 2. Put another way, the flow regulation system of FIG. 2 may implement the method 832.

The downlink signal may be generated using pulses or other changes in fluid flow of a drilling fluid to a downhole tool or BHA. The pulses may be generated in a communication fluid flow pattern, the communication fluid flow pattern including encoded data. As discussed herein, the communication fluid flow pattern may be generated by diverting a portion of the drilling fluid through a flow regulation system in a discharge flow pattern of discharge fluid flow over time. To generate the discharge flow pattern, a communication pressure drop across the flow regulation system may be determined at 834. The communication pressure drop may be the pressure drop across the flow regulation system that may result in the discharge fluid flow.

The flow regulation system includes a variable flow valve. A sensor may be located downstream of the variable flow valve. The flow regulation system may further include a fixed flow valve that discharges to the mud pit. The fixed flow valve may have a known pressure drop, resulting in a discharge pressure downstream of the variable flow valve. Using the known pressure drop across the fixed flow valve, a variable valve pressure may be determined for the discharge fluid flow between the variable flow valve and the fixed flow valve at 836. The variable valve pressure may be measured at 838.

In some embodiments, the method 832 may include determining 840 if the measured valve pressure is equal to the determined variable valve pressure. If the measured valve pressure is not equal to the determined variable valve pressure, then the position of the variable flow valve may be adjusted at 842. After the position of the variable flow valve is adjusted, the valve pressure of the variable flow valve may be measured again and the measured valve pressure compared to the determined variable valve pressure. This process may be repeated until the measured valve pressure equals the determined variable valve pressure. When the measured valve pressure is equal to the variable valve pressure, then the next communication pressure drop for the flow regulation system may be determined and the method 832 repeated for the next communication pressure drop. In this manner, the method 832 may allow a drilling operator to generate a flexible downlink signal in the drilling fluid that may include a large amount and/or complexity of information.

Figure 9:
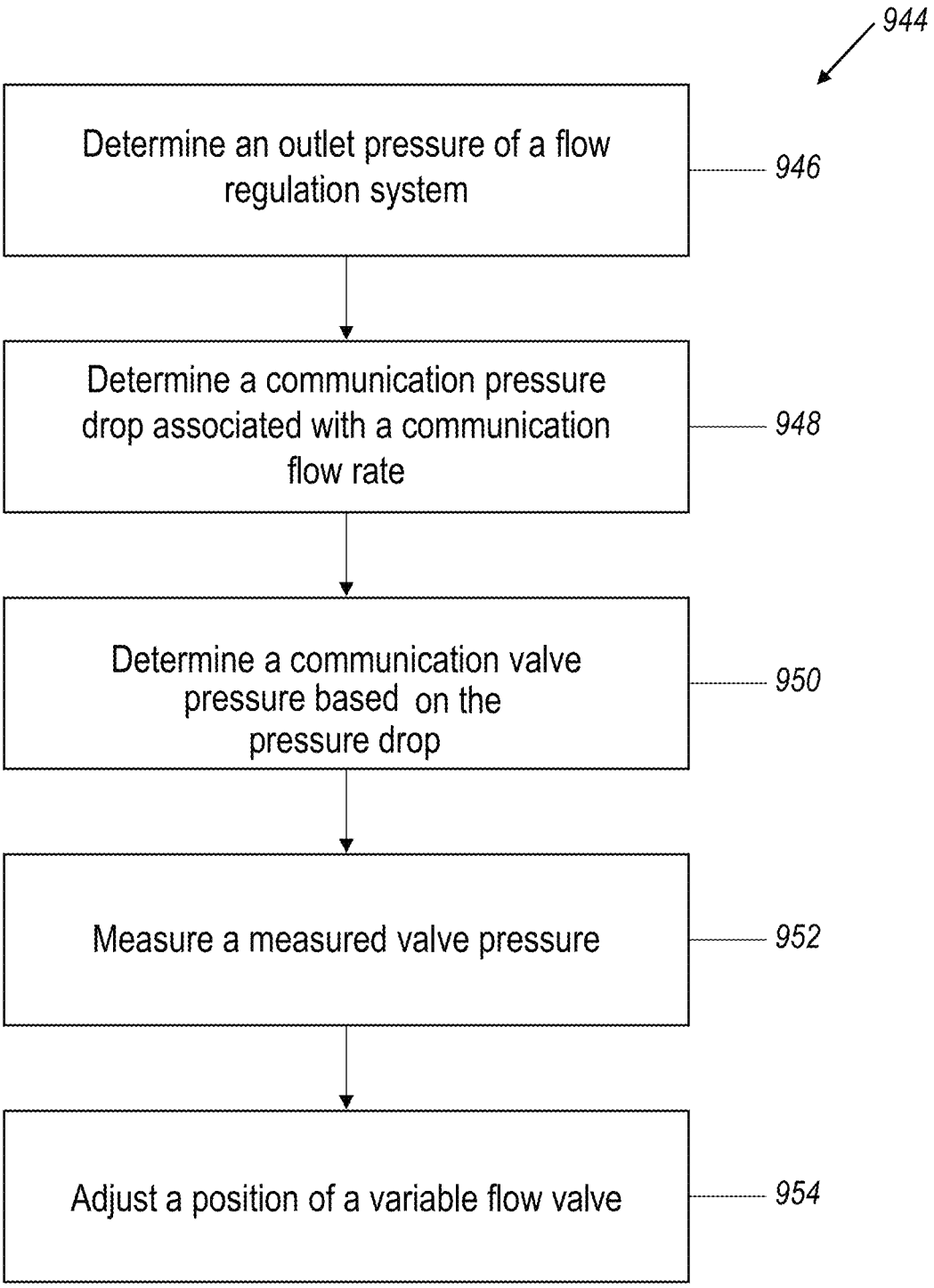
FIG. 9 is a flow chart of a method for generating a downlink signal, according to at least one embodiment of the present disclosure.

FIG. 9 is a flow chart of a method 944 for generating a downlink signal, according to at least one embodiment of the present disclosure. The method 944 includes determining an outlet pressure of a flow regulation system at 946. In some embodiments, the outlet pressure may be the pressure of the flow regulation system downstream of a variable flow valve. In some embodiments, determining the outlet pressure may include measuring the outlet pressure with a pressure sensor. In some embodiments, determining the outlet pressure may include determining a fixed pressure drop across a fixed flow valve downstream of the variable flow valve. In some embodiments, determining the outlet pressure may include determining the head losses caused by a discharge pipe between the fixed flow valve and the outlet.

The method 944 may further include determining a communication pressure drop across the flow regulation system at 948. In some embodiments, the communication pressure drop is determined using a discharge fluid flow. The communication pressure drop may be the pressure drop across the entire flow regulation system. A variable valve pressure may be determined using the communication pressure drop at 950. In some embodiments, the variable valve pressure is determined using the outlet pressure. In some embodiments, the variable valve pressure downstream of the variable flow valve may be measured using a pressure sensor at 952. If the measured valve pressure is different from the determined variable valve pressure, the position of the variable flow valve may be adjusted until the measured valve pressure equals the determined variable valve pressure.

Figure 10:
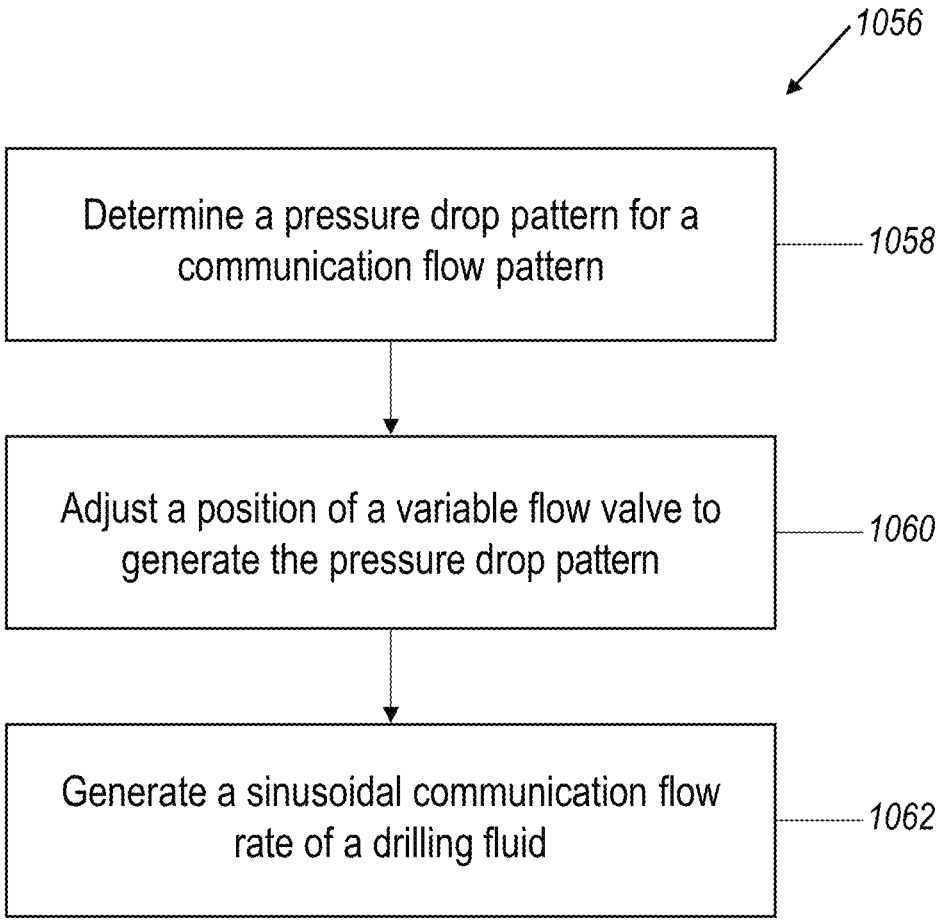
FIG. 10 is a flow chart of a method for generating a downlink signal, according to at least one embodiment of the present disclosure.

FIG. 10 is a flowchart of a method 1056 for generating a downlink signal, according to at least one embodiment of the present disclosure. A discharge flow pattern is developed to generate a fluid flow pattern for a downlink signal. In some embodiments, the discharge flow pattern is used to determine a pressure drop pattern across the flow regulation system at 1058. The discharge flow pattern is generated by adjusting a position of a variable flow valve consistent with the pressure drop pattern at 1060. This may generate a sinusoidal discharge flow pattern, resulting in a sinusoidal communication flow rate of a drilling fluid at 1062.

The embodiments of the flow regulation system have been primarily described with reference to wellbore drilling operations; the flow regulation systems described herein may be used in applications other than the drilling of a wellbore. In other embodiments, flow regulation systems according to the present disclosure may be used outside a wellbore or other downhole environment used for the exploration or production of natural resources. For instance, flow regulation systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A flow regulation system, comprising:

a variable flow valve;

a fixed flow valve downstream of the variable flow valve;

an outlet extending to a drilling fluid pit downstream of the fixed flow valve, wherein the fixed flow valve is between the variable flow valve and the drilling fluid pit; and a pressure sensor located between the variable flow valve and the fixed flow valve.

2. The flow regulation system of claim 1, wherein the pressure sensor is a single pressure sensor.

3. The flow regulation system of claim 1, wherein the pressure sensor is a first pressure sensor, and further comprising a second pressure sensor between the fixed flow valve and the drilling fluid pit.

4. The flow regulation system of claim 1, wherein the variable flow valve is a choke valve.

5. The flow regulation system of claim 1, wherein the variable flow valve is continuously adjustable between a fully open position and a fully closed position.

* * * * *